US005392260A

United States Patent [19]

Kroener et al.

[11] Patent Number: 5,392,260

[45] Date of Patent: Feb. 21, 1995

[54] TIMEPIECE

[75] Inventors: Wolfgang Kroener, Pforzheim, Germany; Edwin Jakob, Granges, Switzerland

[73] Assignee: Eta SA Fabriques d'Ebauches, Grenchen, Switzerland

[21] Appl. No.: 278,330

[22] Filed: Jul. 21, 1994

[30] Foreign Application Priority Data

Aug. 31, 1993 [CH] Switzerland ..... 2585/93

[51] Int. Cl.[6] ..... G04B 19/24; G04B 27/04

[52] U.S. Cl. ..... 368/36; 368/191

[58] Field of Search ..... 368/28, 31—38, 368/190–195

[56] References Cited

U.S. PATENT DOCUMENTS 567,409 9/1896 Porter .
3,609,955 10/1971 Suzuki ..... 58/4
3,620,006 11/1971 Zaugg ..... 368/36
3,693,345 9/1972 Schneider ..... 368/36
4,274,152 6/1981 Ikegami ..... 368/192
4,727,523 2/1988 Morata ..... 368/191

*Primary Examiner*—Vit W. Miska
*Attorney, Agent, or Firm*—Griffin, Butler, Whisenhunt & Kurtossy

[57] ABSTRACT

The date disc correction mechanism (3) of this timepiece comprises a control stem (7) movable between at least two axial positions, and on which a sliding pinion (9) and a correction pinion (17) are mounted. The sliding pinion exhibits at least one spur (28) provided in order to come into engagement with an opening (25) formed in the correction pinion in one of the axial positions of the stem (7) so as to render the correction pinion fixed in rotation with the sliding pinion (9).

3 Claims, 4 Drawing Sheets

TIMEPIECE

The present invention concerns a timepiece including at least one indicating organ, in particular of dates, and a correction mechanism for said indicating organ, said correction mechanism comprising at least, on the one hand, a control stem movable between at least two axial positions and, on the other hand, a sliding pinion and a correction pinion mounted on said stem, said correction pinion being free in rotation and one of its faces being formed so as to be able to cooperate with one of the faces of the sliding pinion and to permit driving of said correction pinion by the sliding pinion when said control stem is in a first one of said axial positions.

BACKGROUND OF THE INVENTION

Such timepieces are per se well known. In these timepieces, the sliding pinion and the correction pinion each show, in most cases, contrate teeth and the driving of the correction pinion is assured by cooperation of these two sets of teeth. Such type of design, however, exhibits drawbacks. Effectively, providing contrate teeth on a pinion implies relatively complex and thus also relatively costly machining operations.

A purpose of the present invention is thus to overcome the drawback which has just been described in providing a timepiece movement in which manufacture of the correction mechanism is rendered more simple and more economical.

SUMMARY OF THE INVENTION

To this effect the present invention has as object a timepiece including at least one indicating organ, in particular for dates, and a correction mechanism for said indicating organ, said correction mechanism comprising at least, on the one hand, a control stem movable between at least two axial positions, and, on the other hand, a sliding pinion and a correction pinion mounted on said stem, said correction pinion being free to rotate and one of its faces being formed so as to be able to cooperate with one of the faces of the sliding pinion and to permit driving of said correction pinion by the sliding pinion when said control stem is in a first one of said axial positions, characterized in that said face of the sliding pinion exhibits at least one spur arranged at a distance from the rotation axis of said sliding pinion and in that said spur is intended to come into engagement in an opening formed in said face of said correction pinion, so as to cooperate with a side of said opening in a manner to drive said correction pinion in rotation.

Thanks to these characteristics, it is no longer necessary to form contrate teeth on the correction pinion and said opening formed in the face of the latter and which replaces the contrate teeth can be simply formed by stamping. Furthermore, said spur formed on the face of the sliding pinion is easier to obtain than a complete set of contrate teeth.

According to an advantageous characteristic of the invention, the correction pinion takes the form of a simple toothed disc pierced in its center by a generally circular hole in which is engaged the control stem, the periphery of said hole further including at least one notch provided to receive said spur of the sliding pinion.

According to another advantageous characteristic of the invention, the periphery of said generally circular hole formed in the correction pinion shows two notches arranged diametrically opposite one another, while the sliding pinion includes two spurs symmetrically arranged on either side of said control stem and provided to engage respectively in the two notches.

Other characteristics and advantages of the present invention will appear in the course of the description which is to follow, given solely by way of example and prepared having reference to the attached drawings.

DESCRIPTION OF THE PREFERRED EMBODIMENT

Figure 1:
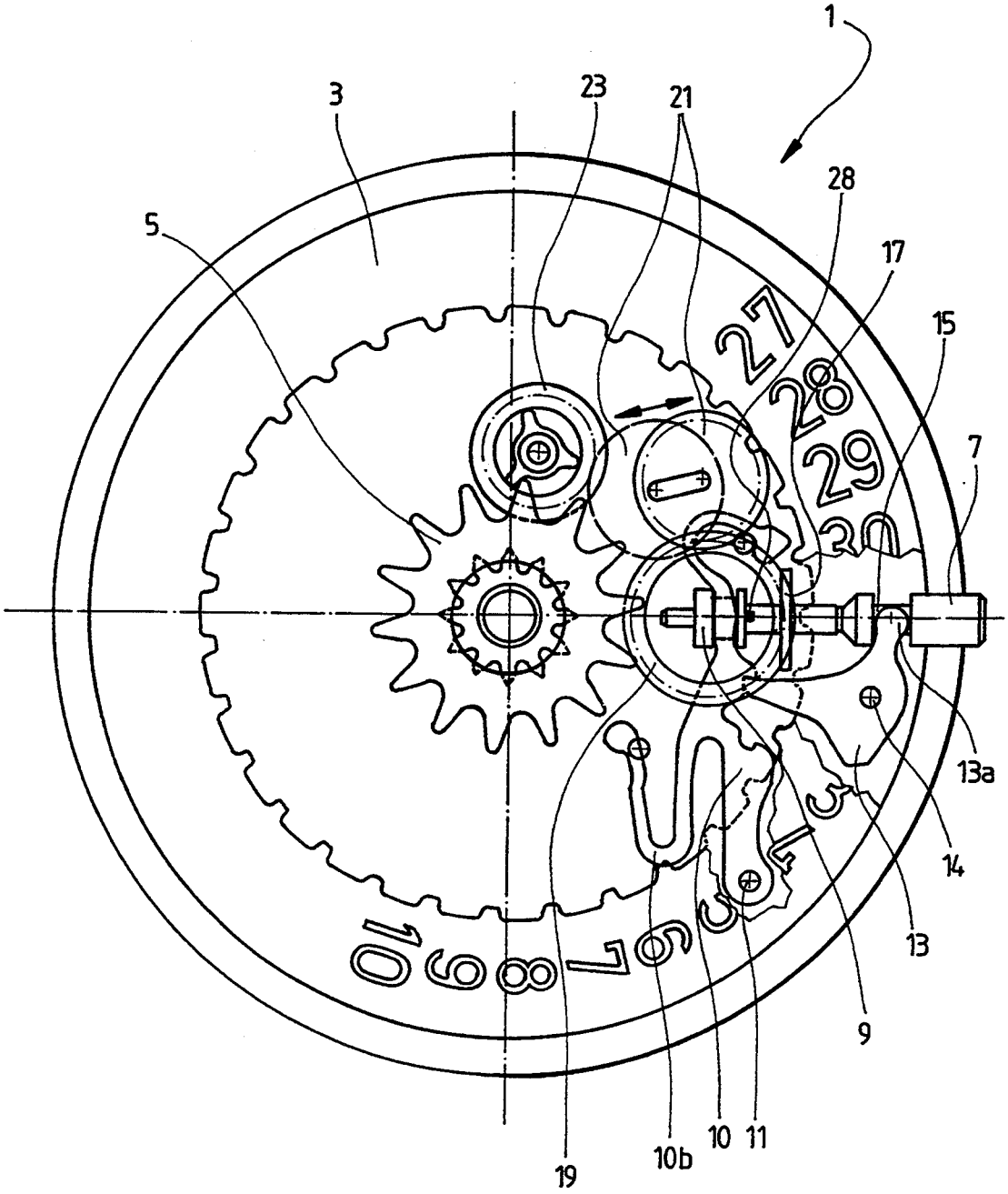
FIG. 1 is a plan view of the movement of a calendar watch according to the invention, in which there has been shown only the date correction organs.

The watch movement 1 shown on FIG. 1 comprises a date indicating organ 3 in the form of a crown exhibiting interior teeth and a day indicator organ in the form of a disc which has not been shown for reasons of clarity. The day disc is in known manner arranged to be driven through a day star 5 to which it is fixed. In a known manner, the movement is arranged to drive the date ring as well as the day disc through one step each twenty-four hours.

Movement 1 further includes a date correction mechanism operated by a control stem 7 movable between three axial positions. Stem 7 bears a sliding pinion 9 actuated in a known manner by a rocking lever 10. Such rocking lever is pivoted on the framework of movement 1 at a point 11 and includes an arm 10*b* acting as return spring. The rocking lever 10 is operated in the usual known manner by a trigger piece 13 pivoted on the framework at a point 14 and which includes an end portion 13*a* engaged in a groove 15 of stem 7.

Stem 7 further bears, loosely mounted thereon, a correction pinion 17 for the day and date 3 indicating organs. The correction pinion 17 is mounted so as to mesh permanently with a first intermediate wheel referenced 19 on FIG. 1 and, conforming to that which will be explained in greater detail hereinafter, it is arranged so as to be driven in rotation by the sliding pinion 9 when stem 7 is in its first drawn-out position (FIG. 2*b*). The first intermediate wheel 19 meshes in turn with a sliding intermediate wheel 21 which, in a known manner, according to the sense of rotation which is imposed thereon, will be placed either in a first position where it meshes with the interior teeth of the date ring 3, or in a second position where it drives the day star 5 via gearing 23.

It will be understood that thanks to this construction when the control stem 7 is placed in the first drawn-out position, the date indication is corrected by causing the stem to rotate in a first sense and the day correction is corrected in causing it to rotate in the other sense.

As we have already said, when the control stem 7 is in the first drawn-out position (FIG. 2*b*), the sliding pinion 9 cooperates with the correction pinion 17 in order to drive the latter in rotation. To this end, the faces of the sliding pinion 9 and of the correction pinion 17 which are opposite one another are formed so as to be capable of cooperating by the engagement of one with the other.

Figure 3:
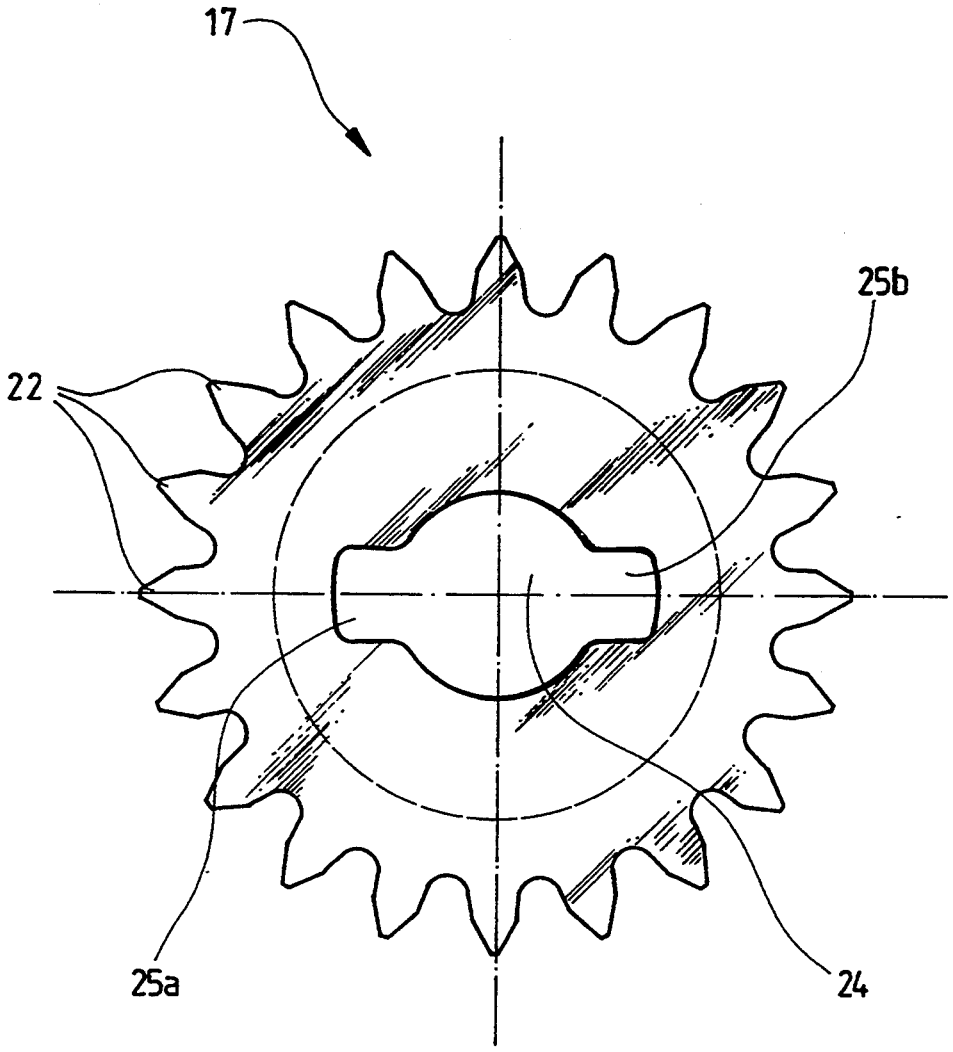
FIG. 3 is a plan view of the correction pinion of the movement of FIG. 1.

On FIG. 3 the correction pinion 17 is shown seen from the face side. It is seen that it has the general form of a flat disc. The periphery of the pinion shows teeth of known type, while its center is pierced by a hole 24 including a central circular portion and two notches 25*a* and 25*b* diametrally opposite one another. Such pinion has the advantage of being adapted to be cut out by a single stamping operation from a simple plate of sheet metal.

The central circular portion of hole 24 is arranged to receive the control stem 7, the diameter of which is substantially equal to that of said circular portion. A minimum amount of play enables stem 7 to turn freely in the circular portion, while permitting centered positioning of the correction pinion on the stem. When the pinion 17 is mounted on stem 7, the two notches 25*a* and 25*b* form two openings located on either side of the axis of stem 7. As is to be seen further on, these two openings are designed to cooperate, in conformity with the invention, with spurs 28*a* and 28*b* arranged to this effect on the sliding pinion 9.

Figure 4:
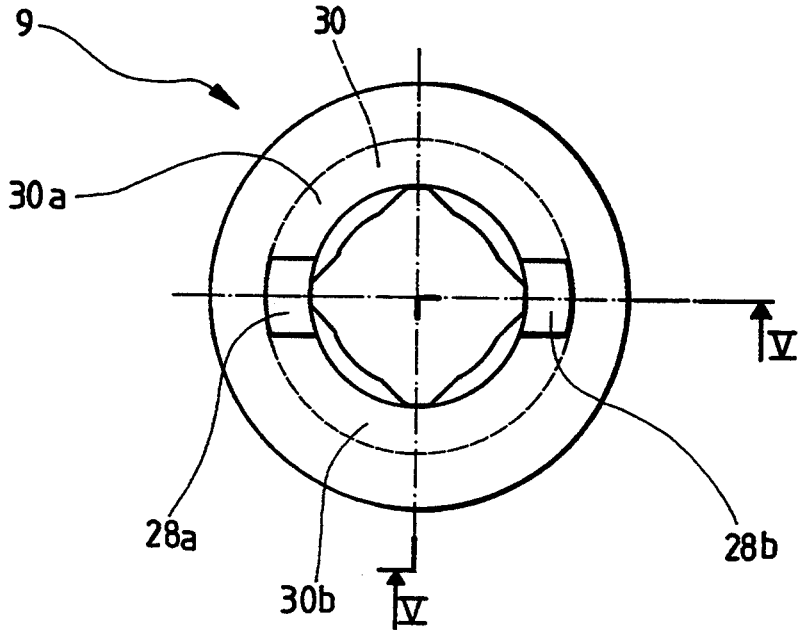
FIGS. 4 and 5 are two views, respectively of the face and in cross-section, of the sliding pinion of the movement of FIG. 1.
Figure 5:
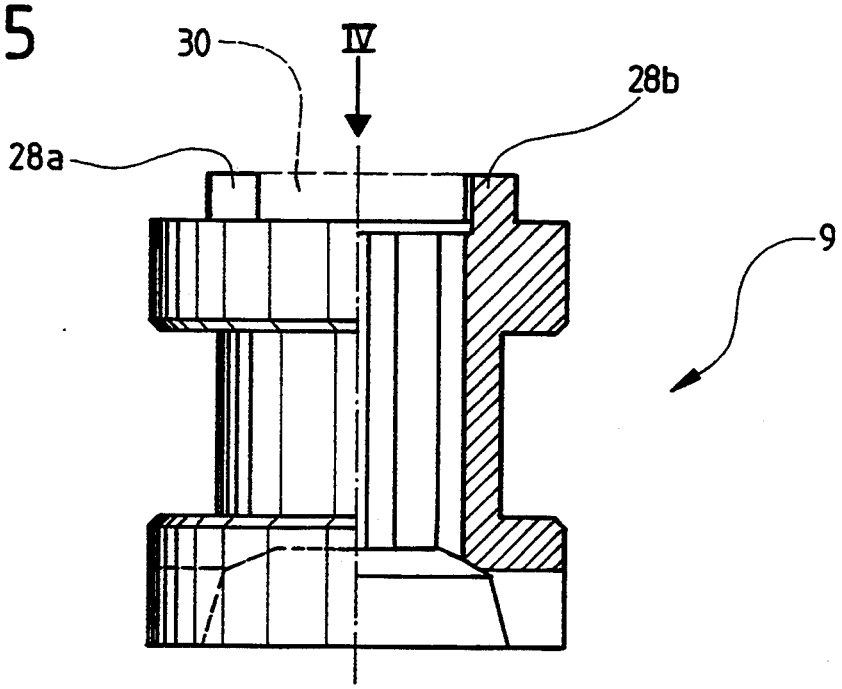

FIGS. 4 and 5 show the sliding pinion 9 respectively from the face side and in longitudinal cross-section. It is seen that apart from the two spurs 28*a* and 28*b* the sliding pinion is of known form. Such form is outwardly that of a surface of revolution which can be obtained from a block of metal by conventional turning operations.

In order to manufacture the sliding pinion according to the invention, there is preferably initially formed, by turning, a part which is entirely symmetric in rotation. Such part does not yet contain the two spurs 28*a* and 28*b*, but on the other hand it includes a crown 30 the contour of which is identified by a broken outline on FIGS. 4 and 5. It is during a subsequent stage that the two spurs 28*a* and 28*b* are formed by milling the material constituting the crown 30. Two milling operations are sufficient in order to remove respectively the material forming two portions of the crown (referenced 30*a* and 30*b* on FIG. 4) and to disengage the two spurs 28*a* and 28*b*. Thanks to this manner of proceeding, the forming of the sliding pinion of the timepiece according to the present invention is particularly simple and inexpensive.

Figure 2A:
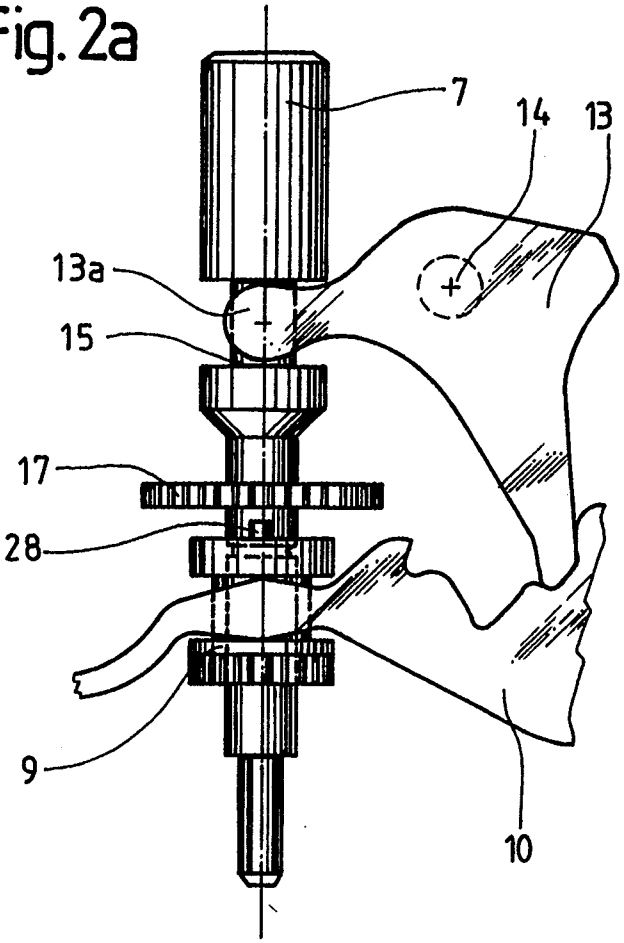
FIGS. 2 and 2*a* are views of the control organ of the movement of FIG. 1 showing it respectively in a neutral position (pushed-in position) and in a date correction position (first drawn-out position)
Figure 2B:
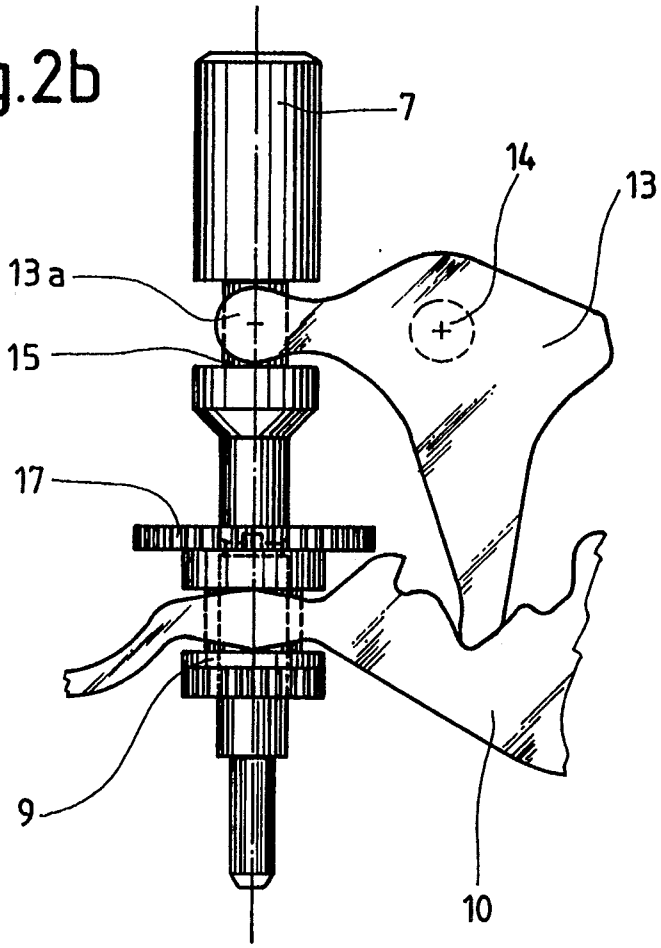

As is visible in particular on FIGS. 2*a* and 2*b* when the sliding pinion 9 is mounted in movement 1, the face of the latter which bears the two spurs 28*a* and 28*b* is found facing the correction pinion 17. FIGS. 2*a* and 2*b* show how the rocking lever 10 controls the longitudinal positioning of the sliding pinion 9 along the control stem 7. When the control stem 7 is brought from the neutral position (pushed-in position shown on FIG. 2*a*) to the date correction position (first drawn-out position shown on FIG. 2*b*), the two spurs 28*a* and 28*b* of the sliding pinion 9 come to bear against the face of the correction pinion 17. Such correction pinion includes, as we have already said, two notches 25*a* and 25*b* which are respectively provided to receive the two spurs of the sliding pinion. However, the two spurs 28*a* and 28*b* are not generally located exactly facing the notches 25*a* and 25*b* at the moment at which one pulls on the control stem. In the most frequent case, the two spurs thus come to bear against the face of the correction pinion 17 without being engaged in the two notches of the latter. In this position, when the stem 7 is rotated, the sliding pinion 9 which is fixed thereto in rotation will be able to rotate without driving the correction pinion in rotation. In these conditions, the two spurs of the sliding pinion will slide against the surface of the correction pinion until they encounter the two notches 25*a* and 25*b* and engage in the latter. In these conditions, rotation by a fraction of a turn effected by stem 7 will suffice to bring about latching in rotation of the sliding pinion 9 with the correction pinion 17.

What we claim is:

1. A timepiece including at least one indicating organ, in particular for dates, and a correction mechanism for said indicating organ, said correction mechanism comprising at least, on the one hand, a control stem movable between at least two axial positions, and, on the other hand, a sliding pinion and a correction pinion mounted on said stem, said correction pinion being free to rotate and one of its faces being formed so as to be able to cooperate with one of the faces of the sliding pinion and to permit driving of said correction pinion by the sliding pinion when said control stem is in a first one of said axial positions, said face of the sliding pinion having at least one spur arranged at a distance from the rotation axis of said sliding pinion, said spur being arranged to come into engagement with an opening formed in said face of said correction pinion, so as to cooperate with a side of said opening in a manner to drive said correction pinion in rotation.

2. A timepiece as set forth in claim 1, wherein said correction pinion appears in the form of a toothed disc pierced in its center by a generally circular hole in which said control stem is engaged, the periphery of said generally circular hole including at least one notch formed to receive said spur of the sliding pinion.

3. A timepiece as set forth in claim 2, wherein the periphery of said generally circular hole includes two notches arranged diametrally opposite one another, the sliding pinion including two spurs symmetrically arranged on either side of said control stem and formed so as to engage respectively in said two notches.

* * * * *